US010743580B2

(12) United States Patent
Kane

(10) Patent No.: US 10,743,580 B2
(45) Date of Patent: Aug. 18, 2020

(54) WATER COOLED VAPORIZING SYSTEM

(71) Applicant: Randy M. Kane, Clearwater, FL (US)

(72) Inventor: Randy M. Kane, Clearwater, FL (US)

( * ) Notice: Subject to any disclaimer, the term of this patent is extended or adjusted under 35 U.S.C. 154(b) by 0 days.

(21) Appl. No.: 16/442,683

(22) Filed: Jun. 17, 2019

(65) Prior Publication Data

US 2019/0307171 A1 Oct. 10, 2019

Related U.S. Application Data

(63) Continuation-in-part of application No. 15/131,973, filed on Apr. 18, 2016, now Pat. No. 10,321,714.

(51) Int. Cl.

| | |
|---|---|
| ***A24F 40/57*** | (2020.01) |
| ***A24F 1/32*** | (2006.01) |
| ***A24F 1/30*** | (2006.01) |
| ***B01F 3/04*** | (2006.01) |
| ***H05B 3/46*** | (2006.01) |
| ***F25B 19/00*** | (2006.01) |
| ***B01F 7/00*** | (2006.01) |
| ***A24F 40/00*** | (2020.01) |
| ***A24F 40/42*** | (2020.01) |
| ***A24F 40/46*** | (2020.01) |
| ***A24F 40/60*** | (2020.01) |

(52) U.S. Cl.

CPC ..... *A24F 40/57* (2020.01); *A24F 1/30* (2013.01); *A24F 1/32* (2013.01); *A24F 40/00* (2020.01); *A24F 40/42* (2020.01); *A24F 40/46* (2020.01); *A24F 40/60* (2020.01); *B01F 3/04531* (2013.01); *B01F 7/0025* (2013.01); *F25B 19/00* (2013.01); *H05B 3/46* (2013.01); *B01F 2003/04709* (2013.01)

(58) Field of Classification Search

CPC .. A24F 47/008; A24F 1/02; A24F 1/16; A24F 1/30; A24F 40/57; A24F 40/40

USPC ..... 131/173, 198, 200, 331

See application file for complete search history.

(56) References Cited

U.S. PATENT DOCUMENTS

| | | | | |
|---|---|---|---|---|
| 2,815,030 A * | 12/1957 | Wenger | ..... | A24F 1/30 131/173 |
| 3,394,710 A * | 7/1968 | Chang | ..... | A24F 1/30 131/173 |
| 3,804,100 A * | 4/1974 | Fariello | ..... | A24F 3/00 131/173 |

(Continued)

OTHER PUBLICATIONS

Zobo, Cigarette Water Filter from Red Mana, YouTube Video NPL, May 10, 2013, (Year: 2013).*

*Primary Examiner* — Michael J Felton
*Assistant Examiner* — Taryn Trace Willett

(57) ABSTRACT

A housing assembly is formed of upper and lower cases with top and bottom plates and an intermediate plate separating the upper case and lower cases. An agitation assembly includes water in the lower case. A plurality of paddles submerged in the water are rotatable to agitate the water. An inlet assembly includes an inlet pipe having a top end above the top plate with a module receiver and a bottom end submerged in the water. A vaporizing module is coupled with the module receiver to form an annular passageway terminating at the top end of the inlet pipe. A heater adjacent to the inlet pipe is adapted to heat vaping material whereby gaseous output will tumble down the annular passageway then down the inlet pipe into the water. An outlet assembly includes an outlet pipe having a top end and a bottom end terminating below above the water.

6 Claims, 8 Drawing Sheets

(56) References Cited

U.S. PATENT DOCUMENTS 4,133,318 A * 1/1979 Gross ..... A24F 1/30 131/173
4,203,455 A * 5/1980 Byrd, Jr. ..... A24F 1/30 131/173
5,738,116 A * 4/1998 Truelove ..... A24F 1/30 131/173
6,453,908 B1 * 9/2002 Caballero ..... A24F 1/30 131/173
8,534,296 B2 * 9/2013 Groff ..... A24F 1/30 131/200
2007/0068523 A1 * 3/2007 Fishman ..... A61M 16/12 128/203.12
2008/0029107 A1 * 2/2008 Ruff ..... A24F 1/30 131/173
2012/0097660 A1 * 4/2012 Bao ..... B05B 1/24 219/209
2012/0199572 A1 * 8/2012 Shen ..... A61M 11/041 219/438
2015/0040926 A1 * 2/2015 Saydar ..... B02C 18/186 131/329
2015/0122275 A1 * 5/2015 Wu ..... A24F 47/008 131/329
2015/0136155 A1 * 5/2015 Verleur ..... A61M 11/042 131/328
2015/0257443 A1 * 9/2015 Rado ..... A24F 47/00 392/390
2016/0219937 A1 * 8/2016 Rado ..... A24F 47/008
2016/0227838 A1 * 8/2016 Johnson ..... A61M 15/06
2016/0278436 A1 * 9/2016 Verleur ..... A24F 47/008
2016/0295911 A1 * 10/2016 Kalousek ..... A24F 7/00
2016/0353800 A1 * 12/2016 Di Carlo ..... A24F 47/008
2017/0055579 A1 * 3/2017 Kuna ..... A24F 47/008
2017/0143035 A1 * 5/2017 Pucci ..... H04M 1/7253
2017/0224013 A1 * 8/2017 Huang ..... A24F 47/008

* cited by examiner

FIG. 3
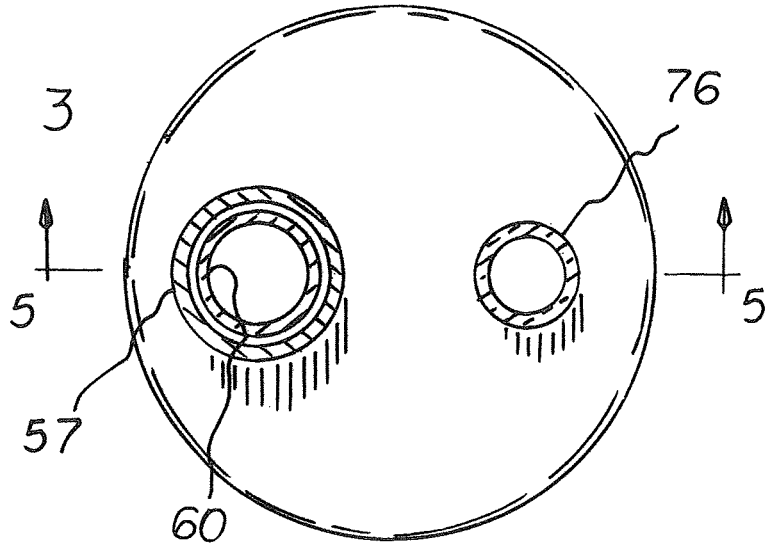
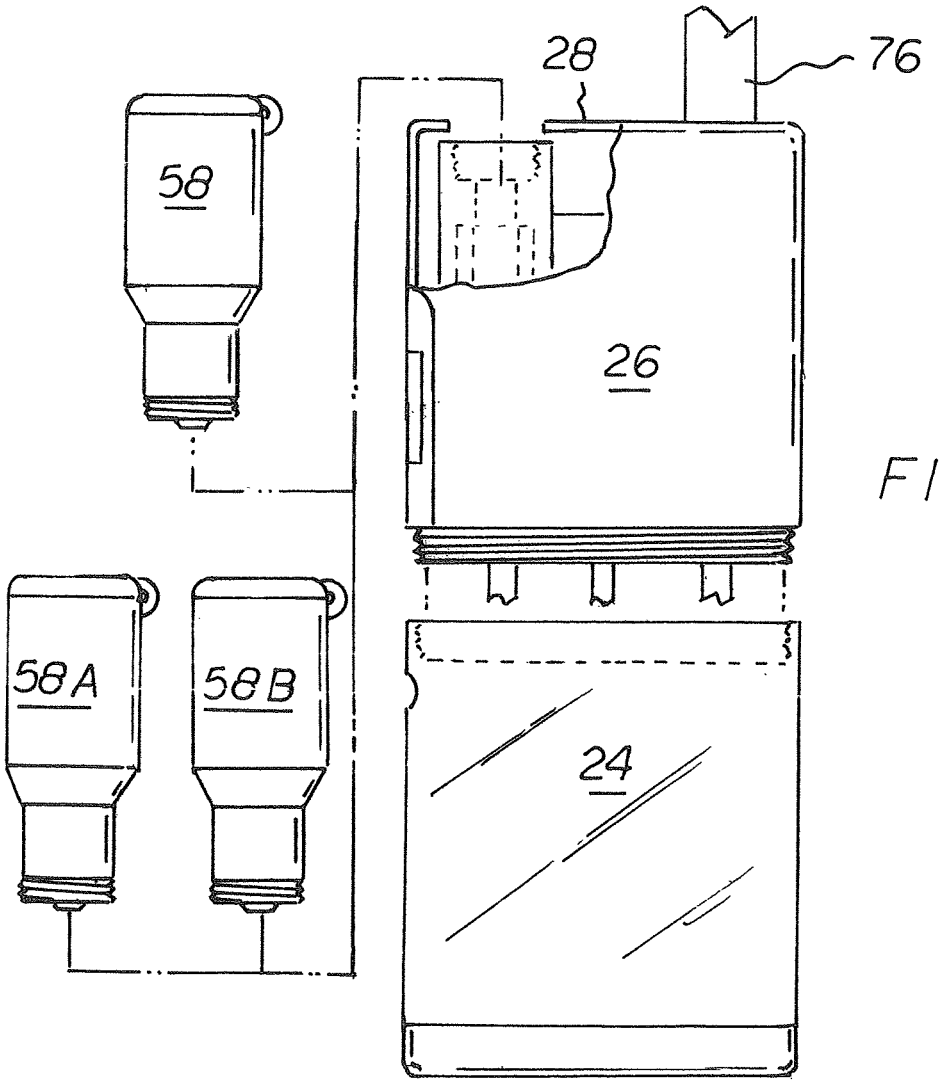
FIG. 4

FIG. 7
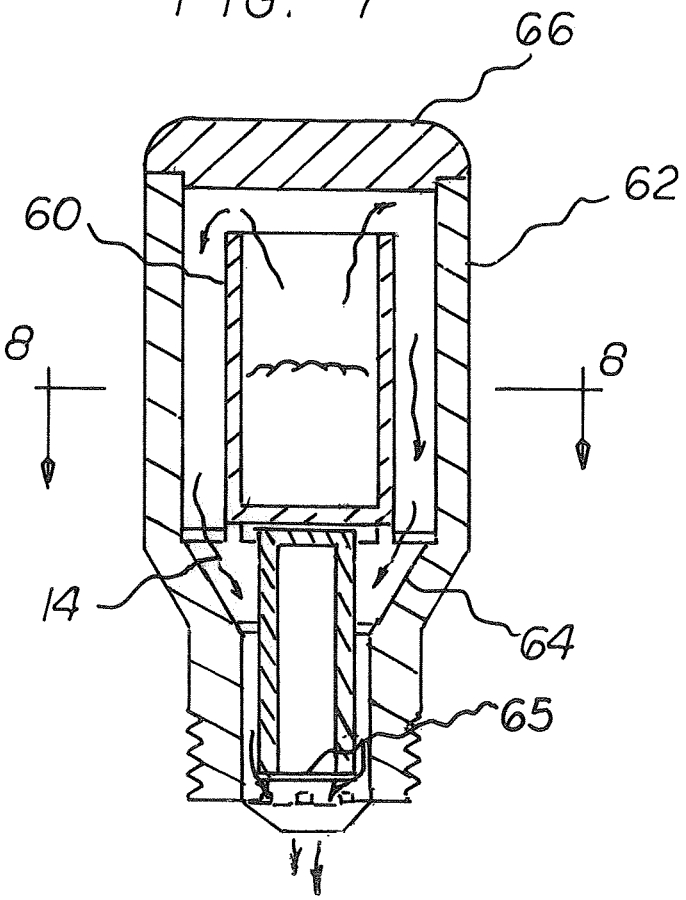
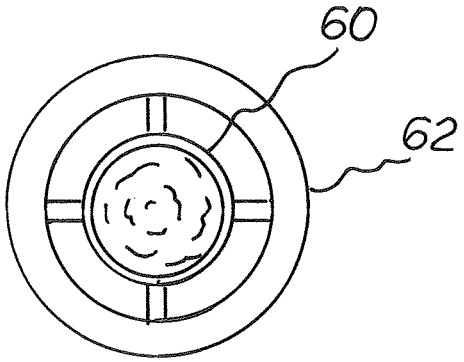
FIG. 8

WATER COOLED VAPORIZING SYSTEM

RELATED APPLICATION

The present invention is a continuation-in-part of pending U.S. patent application Ser. No. 15/131,973 filed Apr. 18, 2016, issuing Jun. 18, 2019, as U.S. Pat. No. 10,321,714, the subject matter of which application is incorporated herein by reference.

BACKGROUND OF THE INVENTION

Field of the Invention

The present invention relates to a 3 in 1 water cooled vaporizing system which allows for a single unit to vaporize herbs, oils, liquids, and concentrates, including tobacco or medicinal marijuana, the vaporizing being done in an improved, safer, more versatile hookah, water pipe style. The system is a smokeless system that heats up the herbal material Instead of combustion, the vaporizing process utilizes a conduction method for the purpose of creating inhalable vapors which cause the essential oils, which contain the active ingredients of the herbal material, to boil until it creates a cooled vapor that can be safely inhaled.

The purpose of this invention is to allow for the user to select a material to be vaporized and place it in 1 of 3 specifically newly created conduction vaporizing chambers that allows for the vaporized material to be drawn downward into the water reservoir where spinning paddles agitate and percolate the water in the reservoir to cleanse, cool and increase the flavor of the cooled vapor inhaled by the user.

Regarding functionality, the selected material like herbals, oils, concentrates, and liquids, including tobacco or medical marijuana is placed in the inventor's newly created vaporizing chamber which is then attached to the upper housing cylinder where electronic sensors detect the chamber attached and heats the chamber to the recommended temperature shown on a liquid crystal display screen attached to the chamber. Once the designated temperature is reached a light emitting diode light is illuminated, which advises the user the desired temperature has been reached. A button is pushed to activate the convection process and the spinning of the paddles in the water reservoirs. The user then inhales through the mouth piece, which draws the heated vapor down from the vaporizing chamber, through the housing into the water reservoir where it is cooled, cleansed, flavor-enhanced and then inhaled as a cooled vapor in a safe, medically-acceptable+, convenient, and economical manner.

DESCRIPTION OF THE PRIOR ART

The use of vaporizing systems of known designs and configurations is known in the prior art. More specifically, vaporizing systems of known designs and configurations previously devised and utilized for the purpose of creating inhalable vapors are known to consist basically of familiar, expected, and obvious structural configurations, notwithstanding the myriad of designs encompassed by the crowded prior art which has been developed for the fulfillment of countless objectives and requirements.

While these known devices fulfill their respective, particular objectives and requirements, including tobacco and medical marijuana, they do not describe a vaporizing system that allows for the selective vaporizing of herbs, oils, liquids and concentrates to a heated vapor, and for agitating a quantity of water below, and for passing the vaporized material as heated vapor through the water to cleanse and cool an enhance the flavor and create an inhalable cooled vapor. The heating, agitating, and passing are all done in a safe, medically-acceptable+, convenient, and economical manner.

In this respect, the water cooled vaporizing 3 in 1 system according to the present invention substantially departs from the conventional concepts and designs of the prior art, and in doing so provides an apparatus primarily developed for the purpose of selective heating of vaporizing material to a heated vapor above, and for spinning, percolating and agitating a quantity of water below, and for passing the vaporized material as heated vapors through the water to cool, cleanse and enhance the flavor and create inhalable cooled vapor, the heating and the agitating and the passing all being done in a safe, medically-acceptable, convenient, and economical manner.

Therefore, it can be appreciated that there exists a continuing need for a new and improved water cooled vaporizing 3 in 1 system which can be used for selectively heating vaporizing material to a heated vapor above, for agitating a quantity of water below, and for passing the heated vapor through the water to create an inhalable cooled vapor. The heating, agitating, and passing are all done in a safe, medically-acceptable, convenient, and economical manner. In this regard, the present invention substantially fulfills this need.

SUMMARY OF THE INVENTION

In view of the disadvantages inherent in the known types of vaporizing systems of known designs and configurations now present in the prior art, the present invention provides an improved water cooled vaporizing 3 in 1 system. As such, the general purpose of the present invention, which will be described subsequently in greater detail, is to provide a new and improved water cooled vaporizing 3 in 1 system and method which has all the advantages of the prior art and none of the disadvantages.

To attain this, for a broad perspective, the present invention essentially comprises a housing assembly formed of upper and lower cases with top and bottom plates and an intermediate plate separating the upper and lower cases. An agitation assembly includes water in the lower case. A plurality of paddles submerged in the water are rotatable to agitate the water. An inlet assembly includes an inlet pipe having a top end above the top plate and a bottom end submerged in the water. A heating assembly includes a chamber interiorly and a cylinder exteriorly forming an annular passageway terminating at the top end of the inlet pipe. A heating coil system within the vaporizing chamber is adapted to vaporize the selected material whereby vapors released will tumble down the annular passageway then down the inlet pipe into the water. An outlet assembly includes an outlet pipe having a top end and a bottom end terminating below above the water.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings.

The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved vaporizing system which has all of the advantages of the prior art vaporizing systems of known designs and configurations and none of the disadvantages.

It is another object of the present invention to provide new and improved modules/chambers, which may be easily manufactured and adapted to other vaporizing apparatuses manufactured and marketed.

It is a further object of the present invention to provide a new and improved vaporizing system with new modules/chambers designed to be attached and locked on to the main unit, which controls the heating temperature or voltage required for the dry herb, flower, liquid, and concentrated paste or wax to be vaporized into a heated vapor.

An even further object of the present invention is to provide a new and improved vaporizing system which is susceptible of a low cost of manufacture with regard to both materials and labor, and which accordingly is then susceptible of low prices of sale to the consuming public, thereby making such vaporizing system economically available to the buying public.

Lastly, it is an object of the present invention to provide a vaporizing system for selective heating of vaporizing material to a heated vapor above, and for spinning, percolating and agitating a quantity of water below, and for passing the vaporized material as heated vapors through the water to cool, cleanse and enhance the flavor and create inhalable cooled vapor, the heating and the agitating and the passing all being done in a safe, medically-acceptable+, convenient, and economical manner.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a cross sectional view taken along line 3-3 of FIG. 1.

FIG. 4 is an exploded front elevational view of the system of the prior Figures.

FIG. 7 is an enlarged cross sectional view of the heating assembly shown in FIG. 1.

FIG. 8 is a cross sectional view taken along line 8-8 of FIG. 7.

The same reference numerals refer to the same parts throughout the various Figures.

DESCRIPTION OF THE PREFERRED EMBODIMENT

Figure 1:
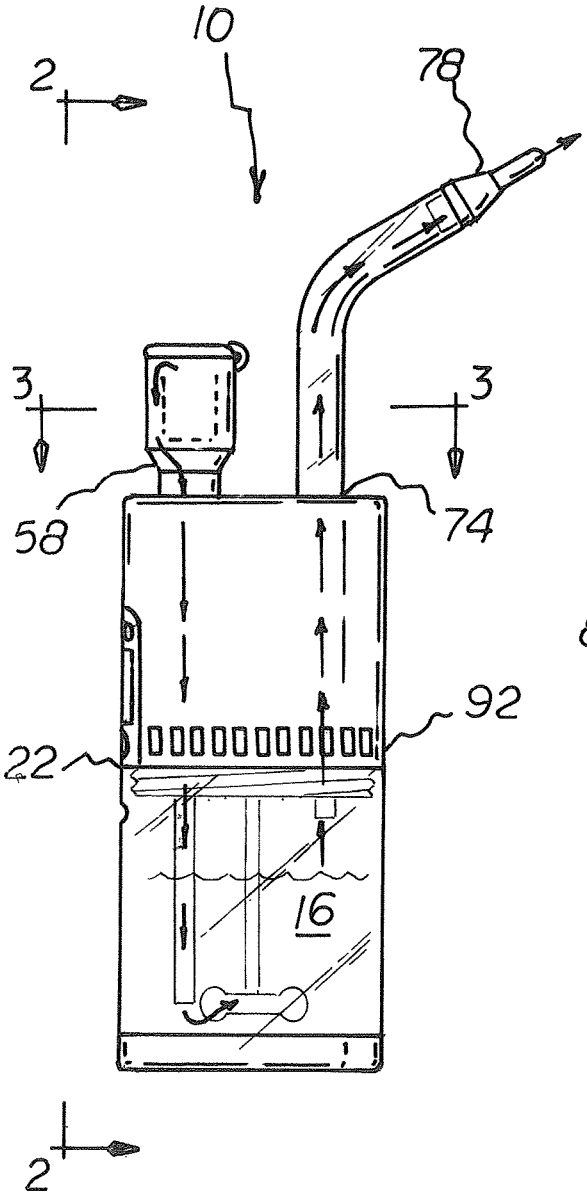
FIG. 1 is a front elevational view of a vaporizing system constructed in accordance with the principles of the present invention.
Figure 2:
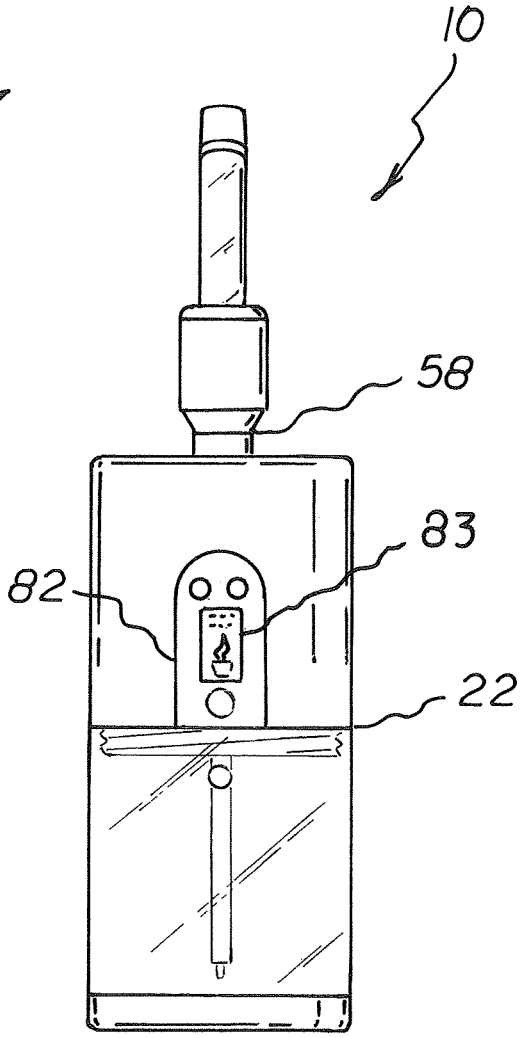
FIG. 2 is a side elevational view taken along line 2-2 of FIG. 1.
Figure 5:
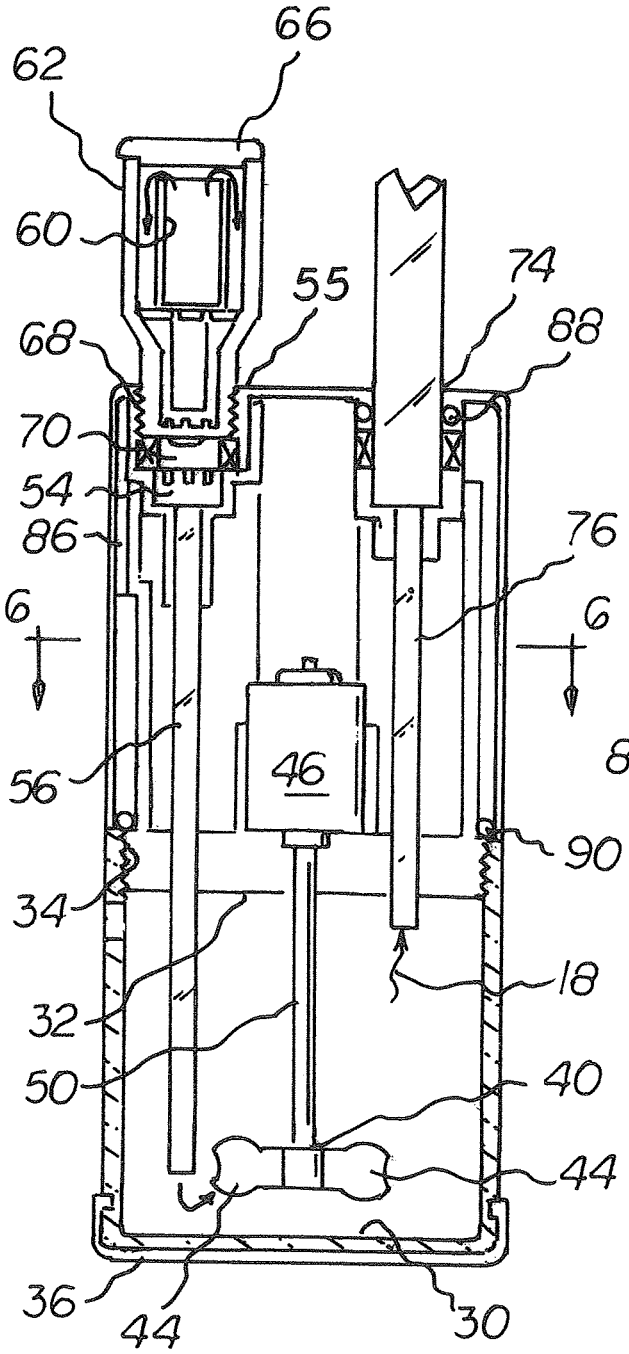
FIG. 5 is a cross sectional view taken along line 5-5 of FIG. 3.
Figure 6:
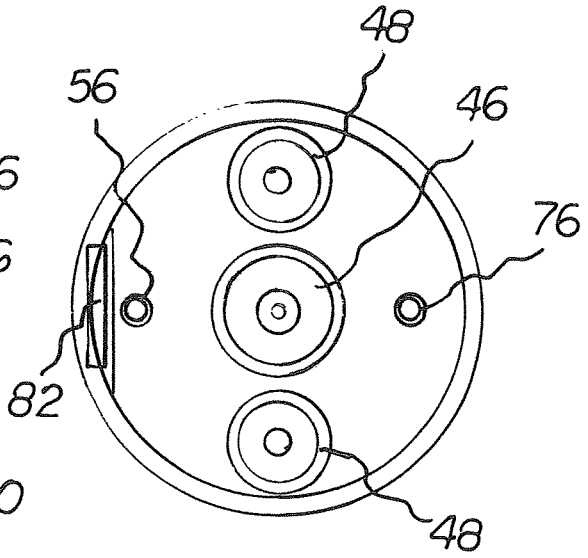
FIG. 6 is a cross sectional view taken along line 6-6 of FIG. 5.
Figure 9:
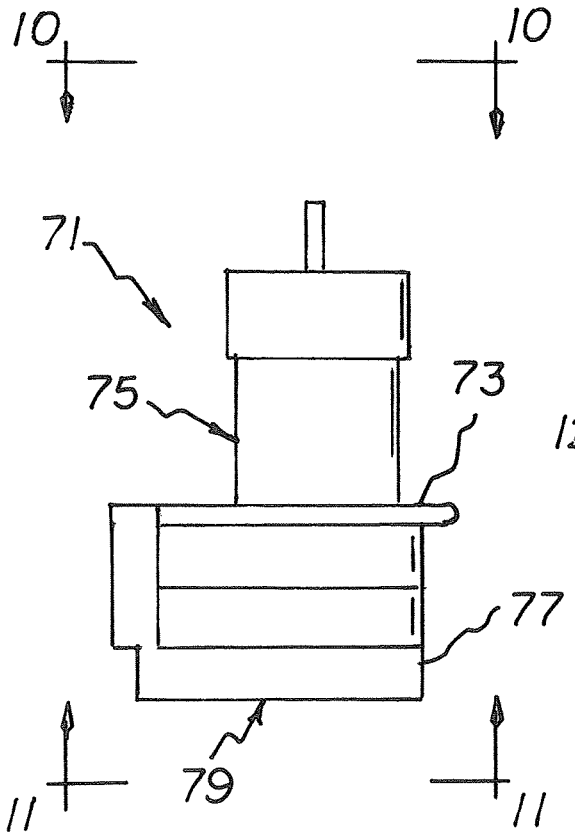
FIG. 9 is a side elevational view of a vaporizing module for dried flower.
Figure 10:
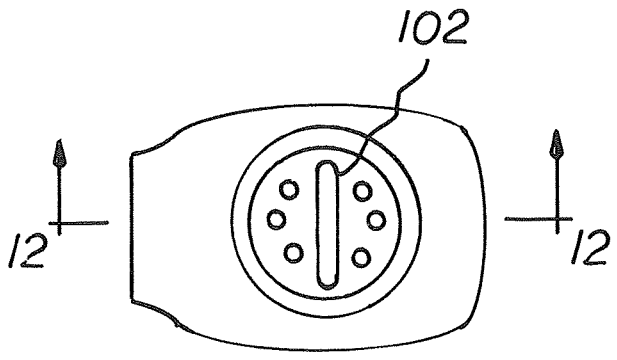
FIG. 10 is a plan view taken along line 10-10 of FIG. 9.
Figure 11:
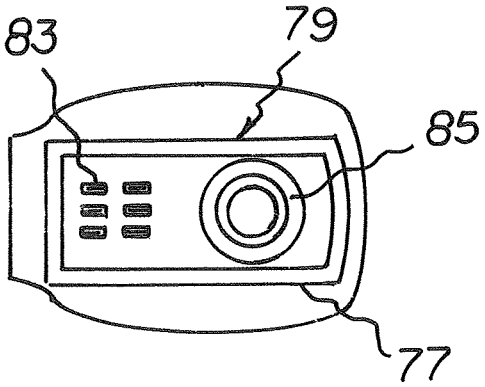
FIG. 11 is a bottom view taken along line 11-11 of FIG. 9.
Figure 12:
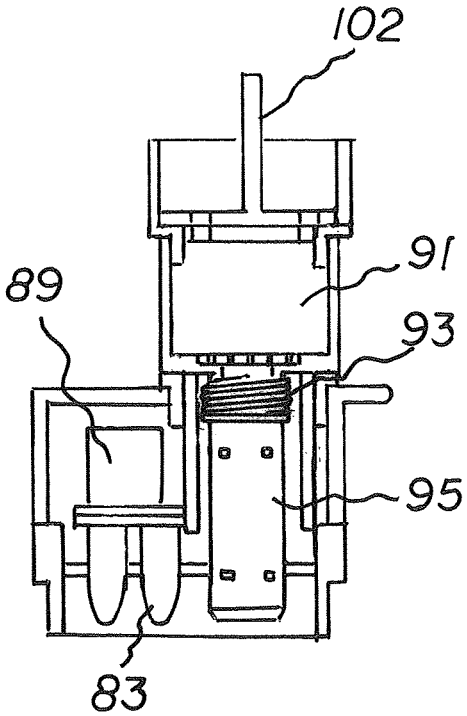
FIG. 12 is a cross sectional view taken along line 12-12 of FIG. 10.
Figure 13:
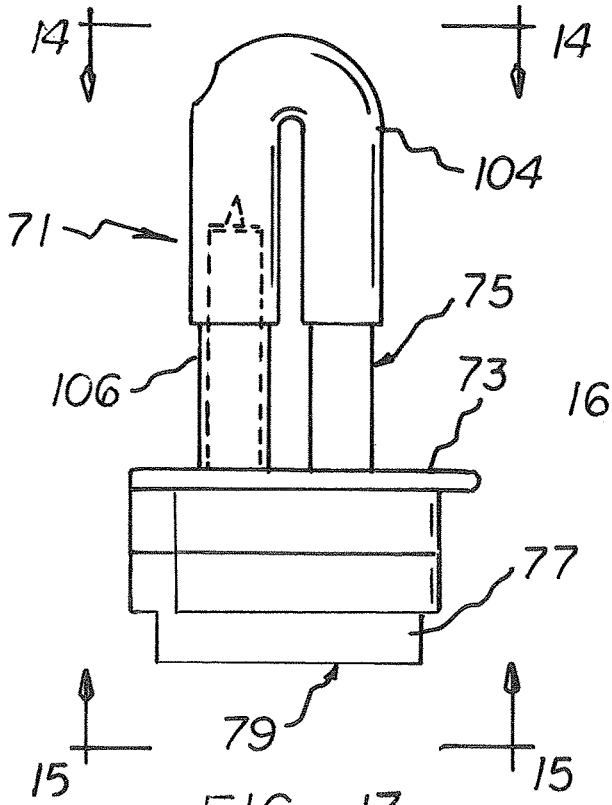
FIG. 13 is a side elevational view of a vaporizing module for receiving a liquid cartridge.
Figure 14:
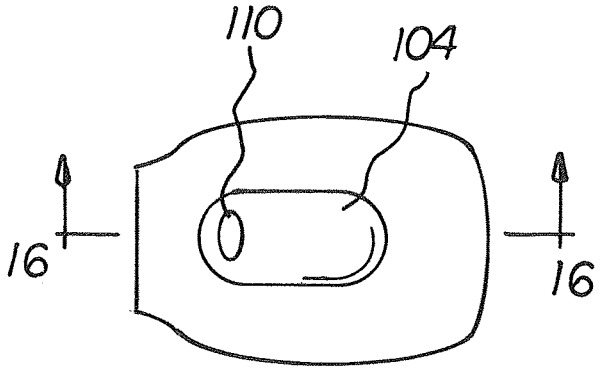
FIG. 14 is a plan view taken along line 14-14 of FIG. 13.
Figure 15:
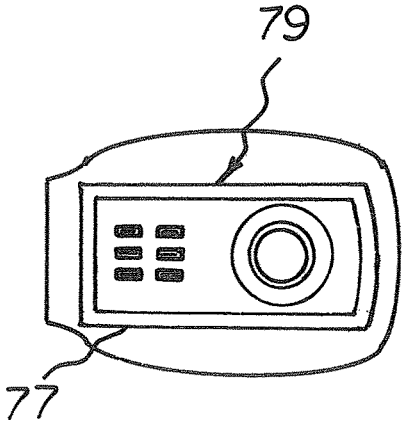
FIG. 15 is a bottom view taken along line 15-15 of FIG. 13.
Figure 16:
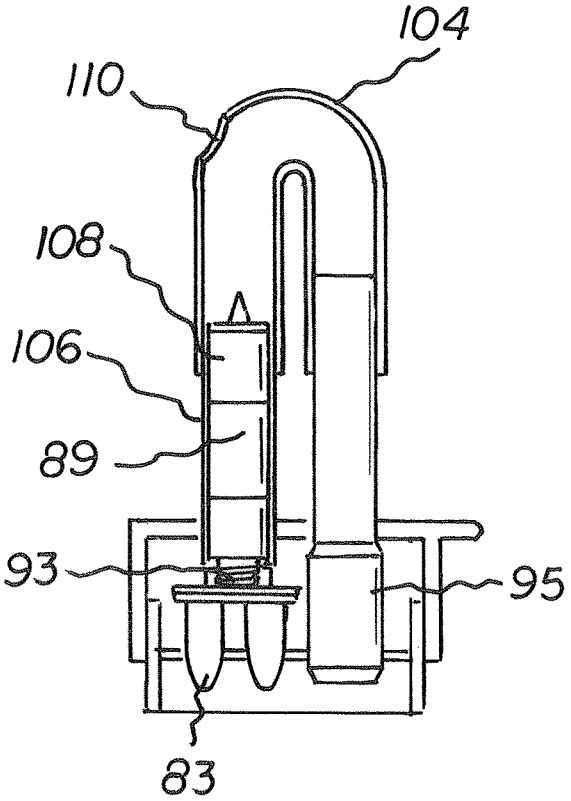
FIG. 16 is a cross sectional view taken along line 16-16 of FIG. 14.
Figure 17:
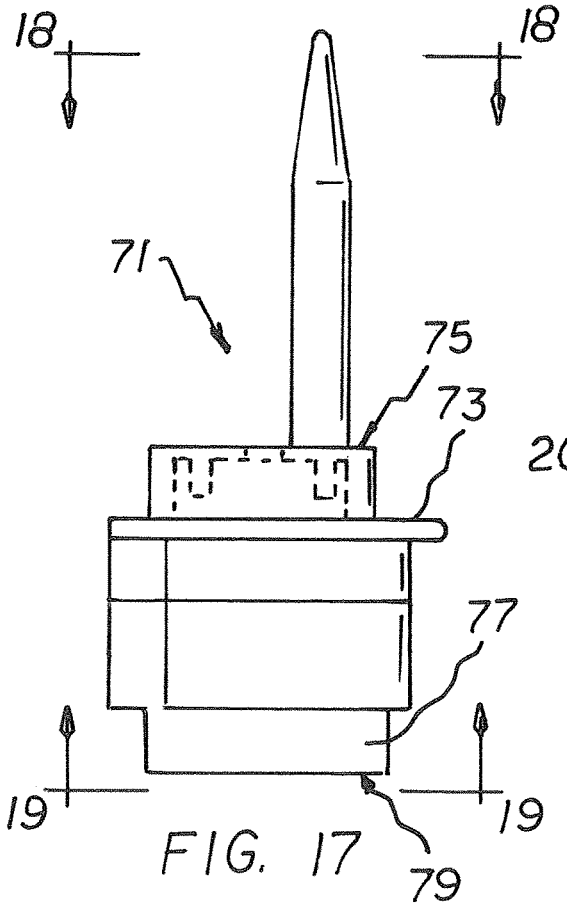
FIG. 17 is a side elevational view of a vaporizing module for concentrated materials.
Figure 18:
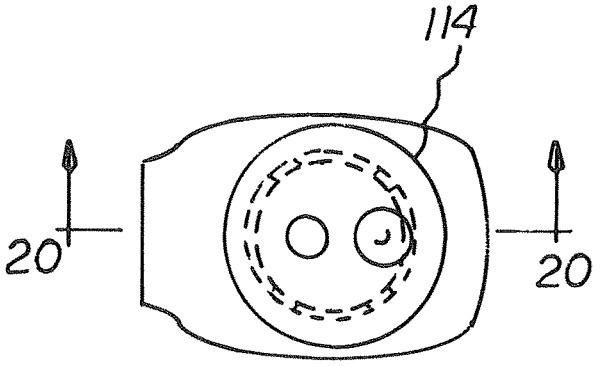
FIG. 18 is a plan view taken along line 18-18 of FIG. 17.
Figure 19:
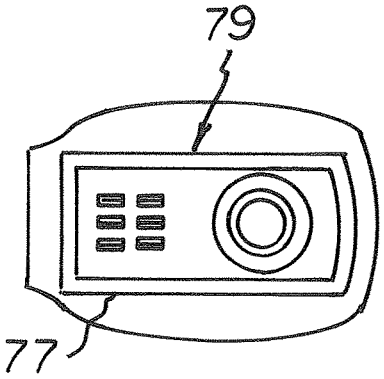
FIG. 19 is a bottom view taken along line 19-19 of FIG. 17.
Figure 20:
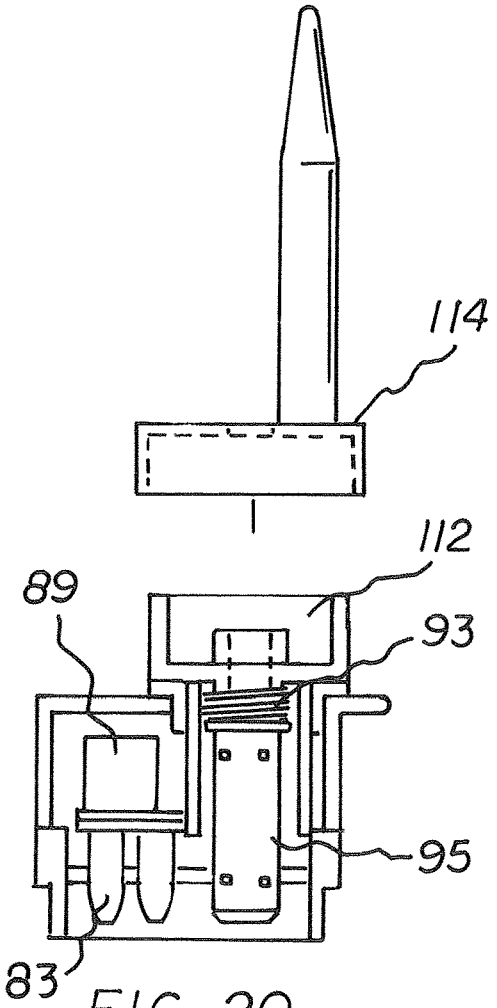
FIG. 20 is a cross sectional view taken along line 20-20 of FIG. 18.
Figure 21:
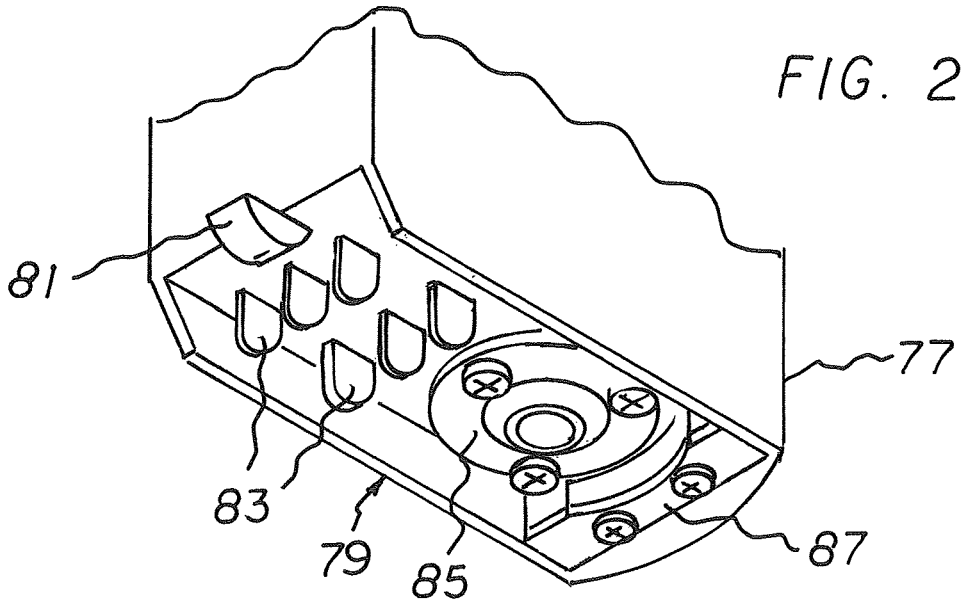
FIG. 21 is a perspective sectional illustration of the lower end of each vaporizing module, the module being partly broken away and shown in section.

With reference now to the drawings, and in particular to FIG. 1 thereof, the preferred embodiment of the new and improved water cooled vaporizing system embodying the principles and concepts of the present invention and generally designated by the reference numeral 10 will be described.

The present invention, the vaporizing system 10 is comprised of a plurality of components. Such components in their broadest context include a housing assembly, an agitation assembly, and an inlet assembly, a heating assembly, and an outlet assembly. Such components are individually configured and correlated with respect to each other so as to attain the desired objective.

From a specific perspective, the invention of the present application is a vaporizing system for selective heating of herbal material 12 to a heated vapor 14, for agitating and percolating a quantity of water 16, and for passing vaporized material through the water to create an inhalable cooled vapor 18. The heating, the agitating, and the passing all being done in a safe, medically-acceptable, convenient, and economical manner.

A housing assembly 22 is provided. The housing assembly has a cylindrical configuration with a height and with a diameter. The height is between 200 percent and 250 percent of the diameter. The housing assembly is formed of a lower case 24 with a lower height and an upper case 26 with an upper height. The lower case is fabricated of a transparent medical glass. The upper case is fabricated of an opaque PVC or stainless steel material. The upper height is between 90 percent and 110 percent of the lower height. The housing assembly has a rigid top plate 28, a rigid bottom plate 30, and a rigid intermediate plate 32. The rigid intermediate plate is coupled to the upper case separating the upper case and the lower case during use. Screw threads 34 couple the upper case and the lower case. An anti-skid pad 36 is coupled to the lower case from below to prevent slipping.

An agitation/peculation assembly 40 is next provided in the housing assembly. The agitation assembly includes the quantity of water 16 in the lower case. A plurality of paddles 44 are submerged in the quantity of water. A motor 46 with 2 lithium batteries 48 to power the motor is provided in the upper case.

A drive shaft 50 couples the motor and the plurality of paddles whereby powering the motor will rotate the drive shaft and rotate the paddles and thereby spin and agitate the quantity of water.

Next provided is an inlet assembly 54. The inlet assembly includes an inlet pipe 56. The inlet pipe has a top end above the top plate. The inlet pipe has a bottom end terminating below the intermediate plate submerged in the quantity of water. The inlet pipe includes an intermediate extent passing through the top plate and the upper case and the intermediate plate.

A heating assembly 58 is next provided. The heating assembly has a 3 individual vaporizing chambers 58, 58A, 58B to handle herbal, oils and or concentrates of selected material 60 interiorly and a stainless steel cylinder 62 exteriorly. A coupling section 64 extends downwardly from the stainless steel or glass cylinder forming an annular passageway between the vaporizing chamber and the stainless steel or glass cylinder with a lid 66 there above. The annular passageway terminates at the top end of the inlet pipe. Upper screw threads 68 removably couple the heating assembly to the upper case.

A plurality of heating coils & assemblies are selectable to conduct the material within the vaporizing chamber as a function of the nature of the vaporized material in the vaporizing chamber. The vaporized material 12 in the vaporizing chamber is chosen from the class of materials consisting of herbs, concentrates, and liquids. A heater 70 adjacent to the vaporizing chamber is adapted to heat the vaporizing material through convection. In this manner, the vapors created from the convected material will tumble down the annular passageway, then down the inlet pipe into the quantity of water.

An outlet assembly 74 is next provided. The outlet assembly includes an outlet pipe 76. The outlet pipe has a top end above the top plate. The outlet pipe includes a bottom end terminating below the intermediate plate above the quantity of water. The outlet pipe includes an intermediate extent passing through the top plate and the upper case and the bottom plate. The outlet pipe has a lower extent with a smaller diameter and an upper extent with a larger diameter. A mouthpiece 78 is coupled to the top end of the outlet pipe. The mouthpiece is adapted to be drawn on by the user to inhale the vapors passed through the quantity of water agitated in the lower case.

Lastly, a control assembly 82 is provided. The control assembly includes operator accessible components. From top to bottom laterally spaced temperature buttons are provided to select higher and lower temperatures for the heater should the user prefer to vaporize at a temperature not preset to the designated chamber attached. A display of a preset temperature is variable by pressing the laterally spaced buttons. A heating signal is provided to indicate, when illuminated, that the heater is approaching a preset temperature. A power signal is provided to indicate, when illuminated, that power is on. A power/heater button is provided to be depressed to turn the power on and off.

The three vaporizing chambers 58, 58A, and 58B allow for the user to select a material to be vaporized and place it in 1 of the 3 specifically newly created conduction vaporizing chambers. The control assembly is designed to recognize the specific chamber screwed into the housing assembly and then heat the elements within that chamber to the preset temperatures designated for the material including herbs, oils, liquids, concentrates to be vaporized.

The control assembly also includes a) a printed circuit board 86 in the upper case, b) an upper light emitting diode strip 88 in the lid adjacent to the outlet pipe, c) lower light emitting diode strip 90 in the upper case adjacent to the lower screw threads, and d) a USB port 92 is provided for charging the system.

In the preferred embodiment, a plurality of vaporizing modules 71 are provided. Each vaporizing module has an upper end 73 with a vaporizing assembly 75. Each vaporizing module also has a lower end 77 with a coupling assembly 79. Each coupling assembly includes a first projection 81, a plurality of downwardly extending pins 83, a cylindrical collar 85, and a metallic plate 87. A processor 89 is connected to the plurality of downwardly extending pins. Each vaporizing assembly further includes a vaporizing chamber 91 and a plurality of heating coils 93. The plurality of heating coils are made of a 24 gauge kanthal coil wire. A vaporizing tube 95 extends downwardly between the vaporizing chamber and the cylindrical collar to form an annular passageway for vaporized material. Each vaporizing chamber is pre-loaded with a preferred vaping material chosen from the class of vaping materials consisting of herbs, dried flowers, concentrates, liquids, and waxes. The processor is pre-programmed with preferred digital data for heating or applying the necessary voltage based on the pre-loaded vaping material in the vaporizing chamber.

Figure 22:
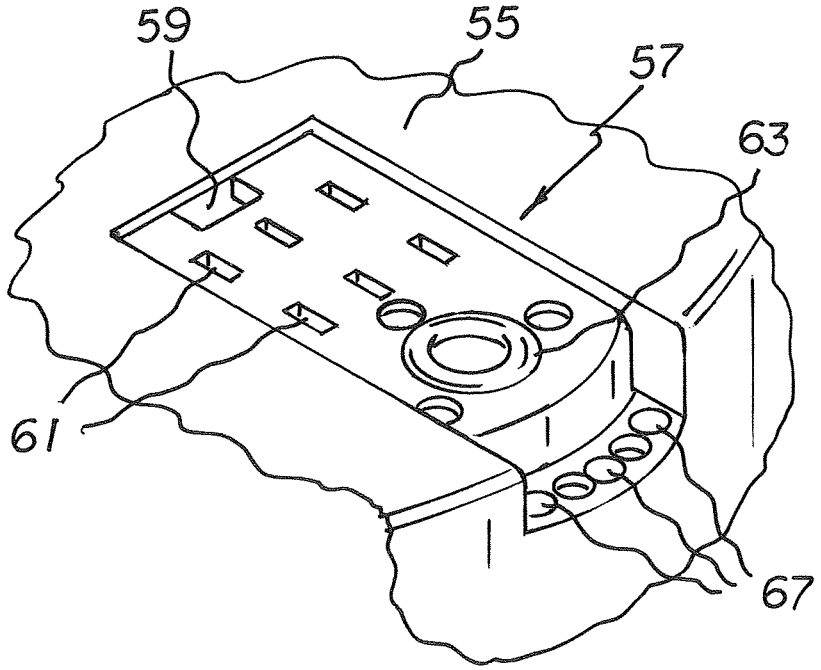
FIG. 22 is a perspective illustration of the magnetic latch assembly, the assembly being partly broken away and shown in section.

The top end of the inlet pipe includes a module receiver. As is best shown in FIG. 22, the module receiver includes a first recess 59, a plurality of second recesses 61, and a cylindrical aperture with an O-ring 63, preferably silicone, for removably receiving the first projection and the plurality of downwardly extending pins and the cylindrical collar of the coupling assembly. The module receiver further includes a plurality of cylindrical magnets 67. The plurality of cylindrical magnets are adapted to magnetically couple with the metallic plate when the coupling assembly is received. The plurality of second recesses are coupled to the printed circuit board for delivering the preferred digital data to the control assembly. The heater is located adjacent to the inlet assembly for heating the plurality of heating coils.

Referring to FIGS. 9-12, a first vaporizing module is shown configured for vaporizing dried flowers. An airflow regulator 102 is positioned above the vaporizing chamber for adjusting the amount of air entering the vaporizing chamber. The processor is pre-programmed with preferred digital data containing desired preset temperatures for vaporizing dried flower. Once the desired preset temperature is reached, the light emitting diodes illuminate a pre-determined color to indicate the dried flower is ready to be inhaled by the user. Additionally, the user can adjust the preset vaporizing temperature and also save the vaporizing settings for future use.

Now referring to FIGS. 13-16, a second vaporizing module is shown configured for vaporizing liquid. A U-shaped tube 104 is provided above the vaporizing assembly for removably receiving a variety of cartridges 106 containing a vaporizable liquid 108. The variety of cartridges include multiple sizes of 510 threaded cartridges from 0.3 ML to 1.5 ML. The U-shaped tube is fabricated of a transparent medical glass. A vent aperture 110 is provided in the upper section above the cartridge for allowing the user to mix air with the heated vaping material. The processor is pre-programmed with digital data containing desired preset temperatures for vaporizing liquid which can be adjusted and saved by the user.

Lastly, a third vaporizing module for vaporizing concentrated solid material, wax, and oils is shown in FIGS. 17-20. A quartz chamber 112 and a quartz cover 114 are provided above the vaporizing assembly for vaporizing concentrated liquid or wax like material. The processor is pre-programmed with digital data containing desired preset temperatures for vaporizing concentrated solid material, wax or oil material which can be adjusted and saved by the user.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A water cooled vaporizing system comprising:

a housing assembly formed of a lower case with a lower height and an upper case with an upper height, the lower case being fabricated of a transparent medical glass, the upper case being fabricated of an opaque stainless steel material, the housing assembly having a rigid top plate, and a rigid bottom plate, and a rigid intermediate plate coupled to the upper case separating the upper case and the lower case during use, screw threads separably coupling the upper case and the lower case, an anti-skid pad coupled to the lower case from below;

an agitation assembly including a quantity of water in the lower case, a plurality of paddles submerged in the quantity of water, a motor with a lithium battery in the upper case to power the motor, a drive shaft coupling the motor and the plurality of paddles whereby powering the motor will rotate the drive shaft and rotate the paddles and thereby agitate the quantity of water;

an inlet assembly including an inlet pipe having a top end located above the top plate, the inlet pipe having a bottom end terminating below the intermediate plate submerged in the quantity of water, the inlet pipe including an intermediate extent passing through the top plate and the upper case and the intermediate plate;

a plurality of vaporizing modules, each vaporizing module having an upper end with a vaporizing assembly, each vaporizing module having a lower end with a coupling assembly, the coupling assembly including a first projection, a plurality of downwardly extending pins, a cylindrical collar, and a metallic plate;

the top end of the inlet assembly having a first recess, a plurality of second recesses, and a cylindrical aperture for removably receiving the first projection and the plurality of downwardly extending pins and the cylindrical collar of the vaporizing module, the top end further having a plurality of cylindrical magnets adjacent to the cylindrical aperture for magnetically coupling with the metallic plate when the coupling assembly is received;

each vaporizing module having a processor connected to the plurality of downwardly extending pins pre-programmed with vaporizing data, each vaporizing assembly including a vaporizing chamber and a plurality of heating coils, a vaporizing tube extending downwardly between the vaporizing chamber and the cylindrical collar forming an annular passageway for vaporized material, each of the plurality of heating coils selectable to heat the vaporizing material in the vaporizing chamber as a function of the nature of the vaporizing material in the vaporizing chamber, the vaporizing material in the vaporizing chamber being chosen from the class of vaporizing materials consisting of herbs, dried flowers, concentrates, liquids, and waxes;

a heater adjacent to the inlet assembly adapted to heat the vaporizing material through convection whereby gaseous output of the heated vaporizing material will tumble down the annular passageway and through the coupling assembly then down the inlet pipe into the quantity of water;

an outlet assembly including an outlet pipe having a top end located above the top plate, the outlet pipe including a bottom end terminating below the intermediate plate in the quantity of water, the outlet pipe including an intermediate extent passing through the top plate and the upper case and the bottom plate, the outlet pipe having a lower extent with a smaller diameter and an upper extent with a larger diameter, a mouthpiece coupled to the top end of the outlet pipe adapted to be sucked by a user to draw up inhalable cooled vapor passed through the quantity of water agitated in the lower case; and a control assembly being configured to recognize the vaporizing data of the designated heating assembly selected from the plurality of heating assemblies, the control assembly further configured to control the heating coils of the corresponding vaporizing chamber of the designated heating assembly according to a preset temperature according to the selected vaporizing material for which the designated heating assembly and the corresponding vaporizing data is configured, the control assembly further including a plurality of spaced operator accessible components, the operator accessible components including from top to bottom laterally spaced temperature buttons to select higher and lower temperatures for the heater, a display of a preset temperature variable by pressing the laterally spaced buttons, a heating signal to indicate when illuminated that the selected module has reached its preset temperature and is ready for use, a power signal to indicate when illuminated that power is on, a power/heater button to be depressed to turn the power on and off, a printed circuit board in the upper case, an upper light emitting diode strip in the lid adjacent to the outlet pipe, a lower light emitting diode strip in the upper case adjacent to the lower screw threads, a USB port for charging the system.

2. The system as set forth in claim 1 wherein the vaporizing module is configured for vaporizing dried flower.

3. The system as set forth in claim 2 wherein the vaporizing module includes an airflow regulator.

4. The system as set forth in claim 1 wherein the vaporizing module includes a U-shaped tube above the vaporizing assembly for removably receiving a corresponding cartridge containing a vaporizing liquid and for vaporizing said vaporizing liquid.

5. The system as set forth in claim 1 wherein the vaporizing module includes a quartz chamber and a quartz cover for vaporizing concentrated material.

6. A water cooled vaporizing vaping system for selective heating of vaporizing material (12) to a heated vapor (14) above, and for spinning, percolating, and agitating a quantity of water (16) below, and for passing the vaporized material as heated vapors through the water to cool, cleanse, and enhance the flavor and create inhalable cooled vapor (18), the system comprising, in combination:

a housing assembly (22) having a cylindrical configuration with a height and with a diameter, the height being between 200 percent and 250 percent of the diameter, the housing assembly formed of a lower case (24) with a lower height, the housing assembly formed of an upper case (26) with an upper height, the lower case being fabricated of a transparent medical glass, the upper case being fabricated of an opaque stainless steel material, the upper height being between 90 percent and 110 percent of the lower height, the housing assembly having a rigid top plate (28), and a rigid bottom plate (30), and a rigid intermediate plate (32) coupled to the upper case separating the upper case and the lower case during use, screw threads (34) separably coupling the upper case and the lower case, an anti-skid pad (36) coupled to the lower case from below;

an agitation assembly (40) in the housing assembly, the agitation assembly including the quantity of water (16) in the lower case, a plurality of paddles (44) submerged in the quantity of water, a motor (46) with a lithium battery (48) in the upper case to power the motor, a drive shaft (50) coupling the motor and the plurality of paddles whereby powering the motor will rotate the drive shaft and rotate the paddles and thereby agitate the quantity of water;

an inlet assembly (54) including an inlet pipe (56) having a top end (55) located above the top plate, the inlet pipe having a bottom end terminating below the intermediate plate submerged in the quantity of water, the inlet pipe including an intermediate extent passing through the top plate and the upper case and the intermediate plate;

a plurality of vaporizing modules (71), each vaporizing module having an upper end (73) with a vaporizing assembly (75), each vaporizing module having a lower end (77) with a coupling assembly (79), the coupling assembly including a first projection (81), a plurality of downwardly extending pins (83), a cylindrical collar (85), and a metallic plate (87);

the top end of the inlet assembly having a first recess (59), a plurality of second recesses (61), and a cylindrical aperture with an O-ring (63) for removably receiving the first projection and the plurality of downwardly extending pins and the cylindrical collar of the vaporizing module, the top end further having a plurality of cylindrical magnets (67) adjacent to the cylindrical aperture for magnetically coupling with the metallic plate when the coupling assembly is received;

each vaporizing module having a processor (89) connected to the plurality of downwardly extending pins pre-programmed with vaporizing data, each vaporizing assembly including a vaporizing chamber (91) and a plurality of heating coils (93), a vaporizing tube (95) extending downwardly between the vaporizing chamber and the cylindrical collar forming an annular passageway for vaporized material, each of the plurality of heating coils selectable to heat the vaporizing material in the vaporizing chamber as a function of the nature of the vaporizing material in the vaporizing chamber, the vaporizing material (12) in the vaporizing chamber being chosen from the class of vaporizing materials consisting of herbs, dried flowers, concentrates, liquids, and waxes;

a first vaporizing module is configured for vaporizing dry flower and further includes an airflow regulator (102) above the vaporizing chamber;

a second vaporizing module is configured with a U-shaped tube (104) above the vaporizing assembly for removably receiving a corresponding cartridge (106) containing a vaporizing liquid (108) and for vaporizing said vaporizing liquid;

a third vaporizing module includes a quartz chamber (112) and a quartz cover (114) for vaporizing concentrated liquid or wax like material;

an outlet assembly (74) including an outlet pipe (76) having a top end located above the top plate, the outlet pipe including a bottom end terminating below the intermediate plate in the quantity of water, the outlet pipe including an intermediate extent passing through the top plate and the upper case and the bottom plate, the outlet pipe having a lower extent with a smaller diameter and an upper extent with a larger diameter, a mouthpiece (78) coupled to the top end of the outlet pipe adapted to be sucked by a user to draw up inhalable cooled vapor passed through the quantity of water agitated in the lower case; and a control assembly (82) being configured to recognize the vaporizing data of the designated heating assembly selected from the plurality of heating assemblies, the control assembly further configured to control the heating coils of the corresponding vaporizing chamber of the designated heating assembly according to a preset temperature according to the selected vaporizing material for which the designated heating assembly and the corresponding vaporizing data is configured, the control assembly further including a plurality of spaced operator accessible components, the operator accessible components including from top to bottom laterally spaced temperature buttons to select higher and lower temperatures for the heater, a display of a preset temperature variable by pressing the laterally spaced buttons, a heating signal to indicate when illuminated that the heater is approaching a preset temperature, a power signal to indicate when illuminated that power is on, a power/heater button to be depressed to turn the power on and off, a printed circuit board (86) in the upper case, an upper light emitting diode strip (88) in the lid adjacent to the outlet pipe, a lower light emitting diode strip (90) in the upper case adjacent to the lower screw threads, a USB port (92) for charging the system.

* * * * *